US008490843B1

(12) United States Patent
Vincent

(10) Patent No.: US 8,490,843 B1
(45) Date of Patent: Jul. 23, 2013

(54) SKI BOOT SPREADER AND METHOD OF USE

(76) Inventor: Arthur Vincent, Chappaqua, NY (US)

( * ) Notice: Subject to any disclaimer, the term of this patent is extended or adjusted under 35 U.S.C. 154(b) by 0 days.

(21) Appl. No.: 13/476,283

(22) Filed: May 21, 2012

(51) Int. Cl.
*A47G 25/80* (2006.01)
*A47G 25/00* (2006.01)

(52) U.S. Cl.
USPC ..... 223/113

(58) Field of Classification Search
USPC .. 223/111, 113–118; 12/114.1–117.4; 81/485
See application file for complete search history.

(56) References Cited

U.S. PATENT DOCUMENTS 4,044,808 A * 8/1977 Kolonia ..... 30/308.1
4,185,347 A * 1/1980 Yang ..... 12/114.6
4,748,755 A * 6/1988 Bain et al. ..... 38/88
D342,870 S * 1/1994 LeClair ..... D7/693
5,470,272 A * 11/1995 Kikuchi et al. ..... 451/344
5,605,500 A * 2/1997 Matechuk ..... 451/456
5,759,094 A * 6/1998 Bosten et al. ..... 451/356
6,616,128 B2 * 9/2003 Selzer ..... 254/104
6,761,292 B1 7/2004 Newman
2004/0159196 A1 * 8/2004 Williams et al. ..... 81/485

* cited by examiner

*Primary Examiner* — Ismael Izaguirre
(74) *Attorney, Agent, or Firm* — Gordon & Jacobson, PC

(57) ABSTRACT

A ski boot spreader has a substantially triangular block and a handle coupled to the block. The block has first and second side surfaces angled relative to each other and forming a leading nose area, a rear side surface extending from the first to the second side surface, top and bottom surfaces, and a flange extending beyond the first and second side surfaces and around the nose area and located toward the bottom surface. In one embodiment, the first and second side surfaces define first and second undercuts extending from a location at or behind the nose area to the rear side surface. In one embodiment, the bottom surface defines a third undercut extending from a location at or behind the nose area to the rear side surface.

18 Claims, 3 Drawing Sheets

SKI BOOT SPREADER AND METHOD OF USE

BACKGROUND

1. Field of the Invention

The subject disclosure relates to a tool for spreading apart the front of a ski boot and a method of its use. More particularly, the subject disclosure relates to spreading apart overlapping pieces of a ski boot to expedite the putting on and taking off of the ski boot.

2. State of the Art

Modern front-entry ski boots include a two-part molded plastic shell. The first part has a base that defines the sole of the boot as well as a toe and heel for engaging with the bindings of the ski. The first part surrounds the foot, the ankle and lower leg of the skier. The first part of the shell is split along its top surface with two sections that overlap one another in a closed position during use. The overlapping of the two sections of the first part in the closed position minimizes the entry of snow and water into the shell during use. The second part of the shell surrounds the upper portion of the first part (the portion surrounding the lower leg of the skier) and is pivotably coupled to the upper portion of the first part typically by a pair of pivot-forming rivets. The first part of the shell receives a liner that is adapted to receive the foot, ankle and lower leg of the skier. The liner has a structure that surrounds the foot, ankle and lower leg of the skier and provides for comfort and warmth. The front top portion of this structure is typically open, and a tongue is provided that closes the opening. Buckles (or other suitable fasteners) are secured to both the first and second parts of the shell to close the shell about the liner and the foot, ankle and lower leg of the skier disposed therein.

Skiers often have difficulty in putting on and taking off front-entry ski boots. This difficulty has been exacerbated by current designs that provide increasingly stiff shells that are intended to permit the skier greater control of the ski. The increased stiffness of the shell of the boot makes it difficult for the skier to negotiate the right angle bend at the ankle joint of the ski boot required during insertion of the skier's foot into the boot. As a result, two people are often required to slide the skier's foot into the ski boot. One person pries open the first part of the boot shell while pulling forward the tongue of the boot liner and the skier opens the second part of the boot shell and pushes his/her foot into the open shell and liner. Aside from requiring two people to put on a ski boot in this manner, often the maneuver is accompanied by cuts to the hands received from the sharp edges of the molded plastic shell of the boot.

SUMMARY

A ski boot spreader has two pieces which may be integral or may be separable. A first piece is a handle. In one embodiment, the handle is formed as a rod with one end having threads for engaging a second piece. In another embodiment, the handle is integrally formed or fixedly coupled to the second piece. The second piece is a generally wedge-shaped or triangular block with a thin flange extending alongside two sides of the block that also provides a leading edge to the front nose of the triangular block. In one embodiment, the block has undercuts that extend from the flange and up two of the sides of the block. These two undercuts terminate behind the nose of the block. In one embodiment, the two undercuts extending from the flange deepen as they extend away from the flange, and provide two shoulders.

In one embodiment, the block has a third undercut located on the bottom surface of the block. In one embodiment, the third undercut extends upward, is centrally located (generally symmetrical around a longitudinal axis), and is generally triangular in cross section. The third undercut deepens as it extends from a narrow front location to a wider back location and forms a generally rounded or arched opening in the rear face of the block. In one embodiment, the top surface of the block has a hole for receiving on end of the handle. The hole may be threaded if the handle is to be removably coupled to the block.

In one embodiment the handle extends perpendicularly from the top face of the block.

In one embodiment, the handle is a straight rod.

In one embodiment, the ski boot spreader is used by gripping the handle, inserting the leading edge of the block at the top (leg portion) of the boot between overlapping pieces, and pushing (jamming) downward to spread the overlapping pieces, thereby expediting insertion of the skier's foot into the boot. According to one aspect, when the ski boot spreader is pushed down, the edges of the overlapping pieces of the boot ride in the undercuts that extend from the flange and up two of the sides of the block. According to another aspect, where a third undercut is provided, the tongue of the boot rides in the third undercut. According to another aspect, the spreader may be left in place (i.e., the skier may let go of the handle), and the skier may use both hands to pull the boot over the skier's foot or to hold the boot while inserting his or her foot. According to a further aspect, after the skier has inserted his or her foot into the boot, the skier may grip the handle of the spreader and pull upward to release the overlapping pieces and remove the spreader.

DETAILED DESCRIPTION OF THE PREFERRED EMBODIMENTS

Turning to FIGS. 1-6, one embodiment of a ski boot spreader 10 is seen. Ski boot spreader has two pieces 20, 30 which may be integral or may be separable. As shown, first piece 20 is a handle, and second piece 30 is a generally wedge-shaped or triangular block.

Figure 1:
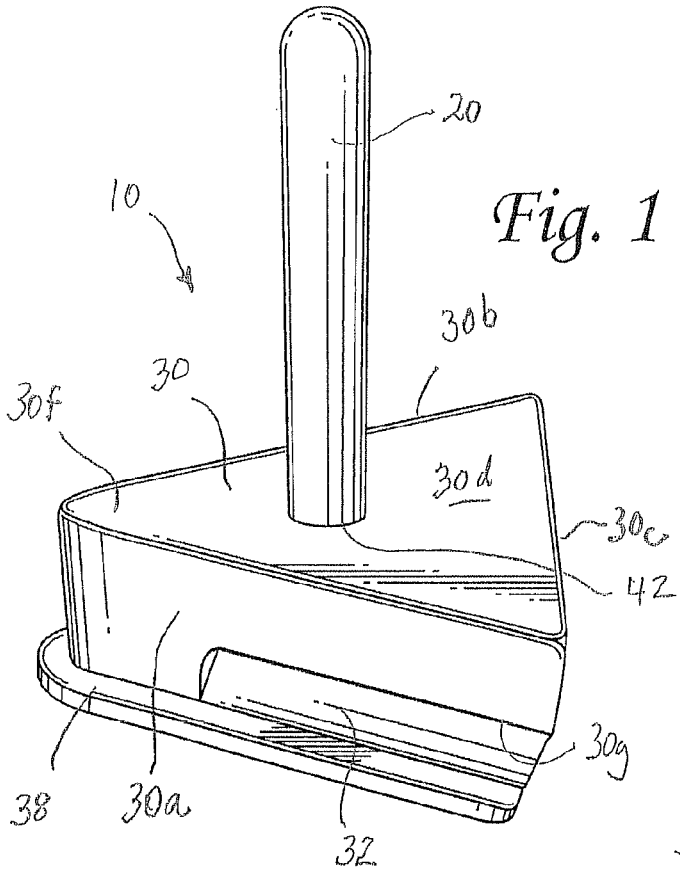
FIG. 1 is a perspective view of a ski boot spreader.
Figure 2:
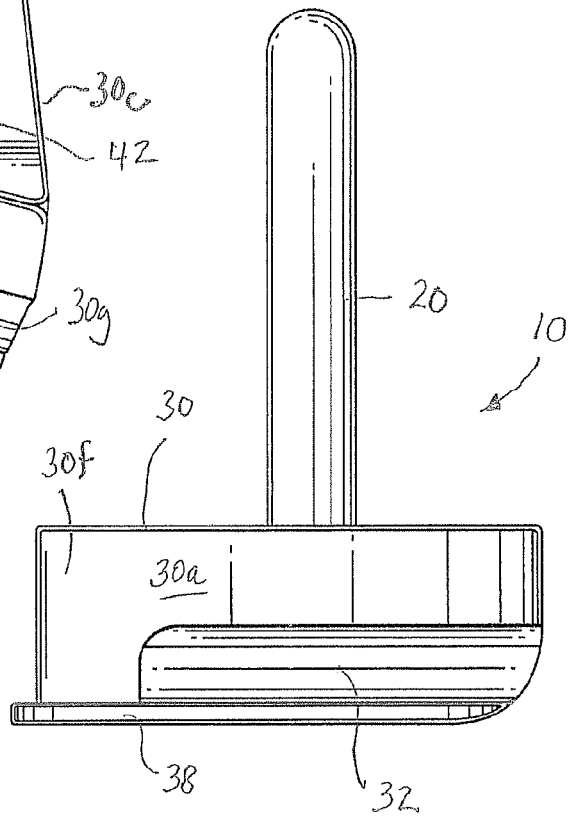
FIG. 2 is a first side view of the ski boot spreader of FIG. 1, the other side view being a mirror image thereof.
Figure 3:
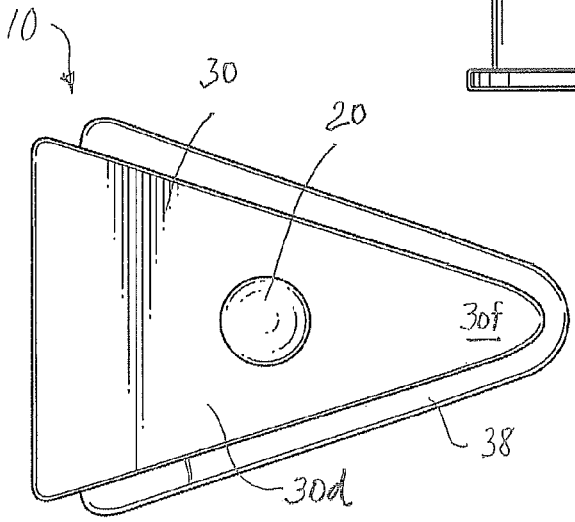
FIG. 3 is a top view of the ski boot spreader of FIG. 1.

In one embodiment, the handle 20 is formed as a rod with one end 22 having threads (not shown) for engaging the block 30. The handle may be a straight rod extending perpendicularly from the block 30 as seen in FIGS. 1-3, or may be provided with a hook or bend (not shown). In addition, the cross section of the handle need not be round.

In another embodiment, the handle 20 is integrally formed or fixedly coupled to the block 30. This may be accomplished by fashioning the handle and block from a single piece of material, or by gluing, welding, or otherwise affixing the handle to the block.

Generally wedge-shaped block 30 is generally triangular with side surfaces 30*a*, 30*b*, 30*c*, a top surface 30*d* and a bottom surface 30*e*. In one embodiment, side surfaces 30*a* and 30*b* that form between them a front nose 30*f* of the block 30 are mirror images of each other. In one embodiment, the back surface 30*c* is shorter in length than the side surfaces 30*a*, 30*b*. In one embodiment the back surface 30*c* makes an angle in range of sixty to eighty-five degrees (more preferably an angle of approximately seventy degrees) with each of the side surfaces 30*a*, 30*b*. In one embodiment, the front nose 30*f* is rounded. It is noted that for purposes of the specification and claims, the term "approximately" is to be understood as plus or minus ten percent.

In one embodiment, the block 30 is provided with a thin bottom flange 38 extending alongside sides 30*a* and 30*b* of the block. Flange 38 also provides a leading edge to the front nose 30*f* of the triangular block; i.e., flange 38 extends continuously front one side of the block to the other. In one embodiment, the flange 38 has a thickness in the range of 0.1 to 0.25 inches (more preferably approximately 0.15 to 0.2 inches in thickness). In one embodiment, the outside edge of the flange 38 is rounded.

In one embodiment, the block is provided with (or generally defines) two undercuts 32, 34 respectively formed in the side surfaces 30*a*, 30*b* of the block 30. In another embodiment, the block 30 is provided with (or generally defines) three undercuts 32, 34, 36 and the thin bottom flange 38. Undercut 36 is formed in the bottom surface 30*e* of block 30.

Figure 6:
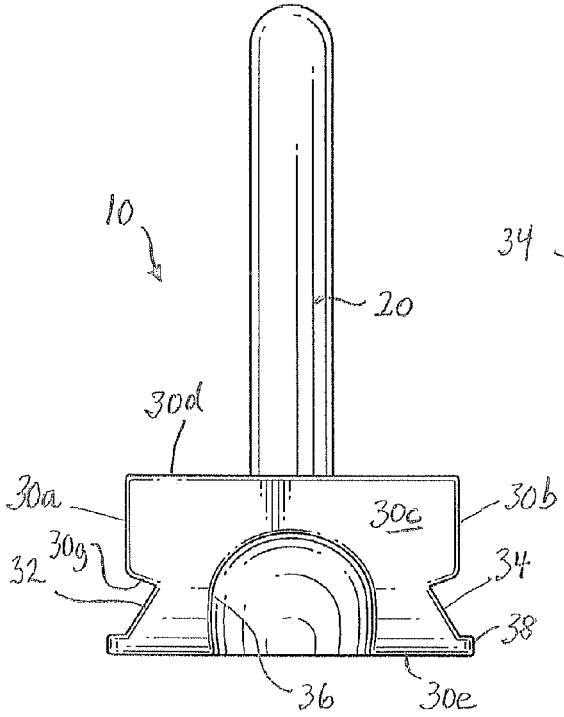
FIG. 6 is a back view of the ski boot spreader of FIG. 1.

As seen best in FIG. 6, undercuts 32 and 34 are cut in the block from the flange upward, and increase in depth as they extend upward, thereby providing an angled surface and a shoulder 30*g*. In one embodiment, the height of the undercuts is approximately forty percent of the height of the side surfaces. In another embodiment, the height of the undercuts is approximately seventy percent of the height of the side surfaces. As seen best in FIG. 2, longitudinally, the undercuts 32, 34 terminate behind the nose 30*f* of the block. As described hereinafter, undercuts 32, 34 are adapted for receiving the overlapping sections of the first part of the boot shell during use, and the shoulder 30*g* prevents the respective shell edge from riding up and over the block 30 during use.

Figure 4:
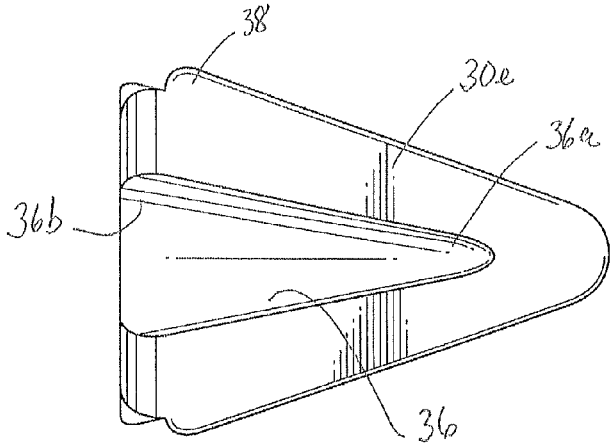
FIG. 4 is a bottom view of the ski boot spreader of FIG. 1.
Figure 5:
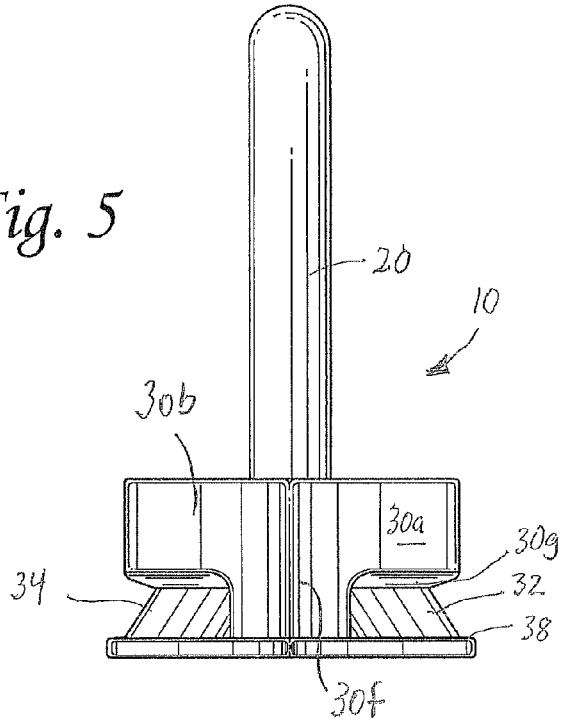
FIG. 5 is a front view of the ski boot spreader of FIG. 1.

As seen best in FIGS. 4 and 6, the third undercut 36 is defined or cut into the bottom surface 30*e* of the block 30. Third undercut 36 is centrally located (generally symmetrical around a longitudinal axis), and is generally triangular in a cross section taken in the plane of the bottom surface. The third undercut deepens as it extends from a narrow front location 36*a* near or at the nose 30*f* to a wider back location 36*b* and forms a generally rounded or arched opening in the rear face 30*c* of the block 30. In one embodiment, at the wider back location 36*b*, the third undercut is approximately half the width of the back surface 30*c*. In one embodiment, the third undercut is approximately seventy percent the height of the block 30 at a central portion of the wider back location 36*b*. In one embodiment, the third undercut runs longitudinally approximately the same length as the side undercuts 32, 34. As described hereinafter, undercut 36 is adapted for receiving the tongue of the ski boot liner during use.

In one embodiment, the top surface 30*d* of the block 30 has a hole 42 which receives an end 22 of the handle 20. In one embodiment, the hole 42 is threaded to permit the handle to be removably coupled to the block 30.

Block 30 may be made from any of many materials such as metal, acrylic, and any of many classes of plastics including thermosets and thermoplastics (e.g., acetal resin, polyamide resin, etc.). In one embodiment, block 30 is made of material which is of a similar hardness to the material of the ski boot with which it is to be used. In another embodiment, block 30 is made of a material which is harder than the material of the ski boot shell with which it is to be used.

In one embodiment the block 30 is approximately one and a half inches high. In another embodiment, the block is approximately one inch high. In another embodiment, the block 30 is approximately two inches high. In these embodiments, the back surface 30*c* of the block 30 has a width in the range of 1.5 inches to 4 inches.

According to one aspect, a different size block 30 may be used for different size ski boots. In one embodiment, as measured along the longitudinal axis, the block 30 may be three inches long for an adult. In another embodiment, the block 30 may be four inches long for an adult. In another embodiment, the block may be two inches long for a child. In another embodiment, the block may be two and a half inches long for a child. It will be appreciated that the block may take different dimensions.

Figure 7:
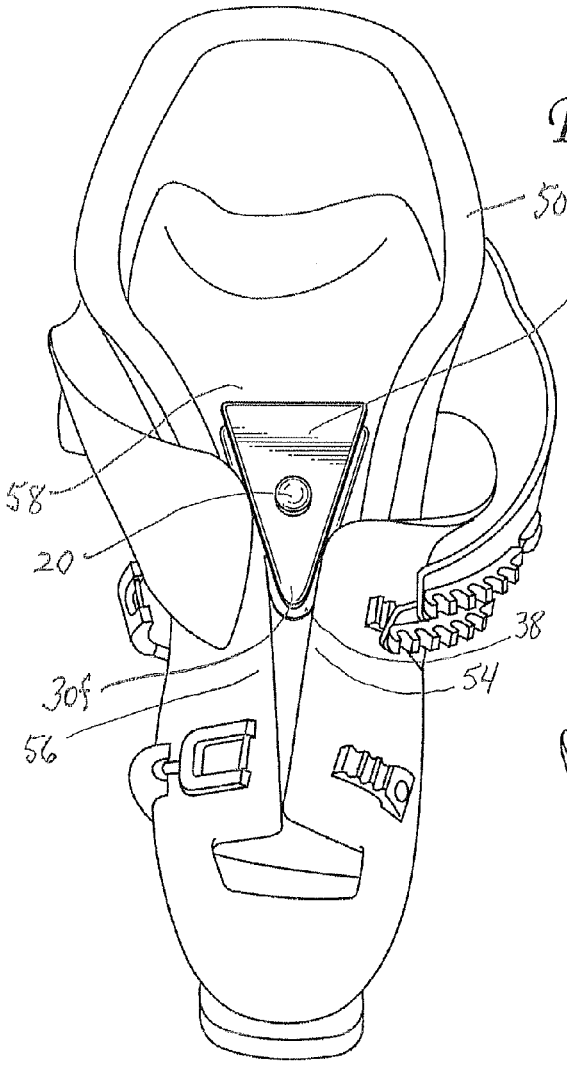
FIG. 7 is a perspective view of the ski boot spreader of FIG. 1 in a first position in a ski boot.
Figure 8:
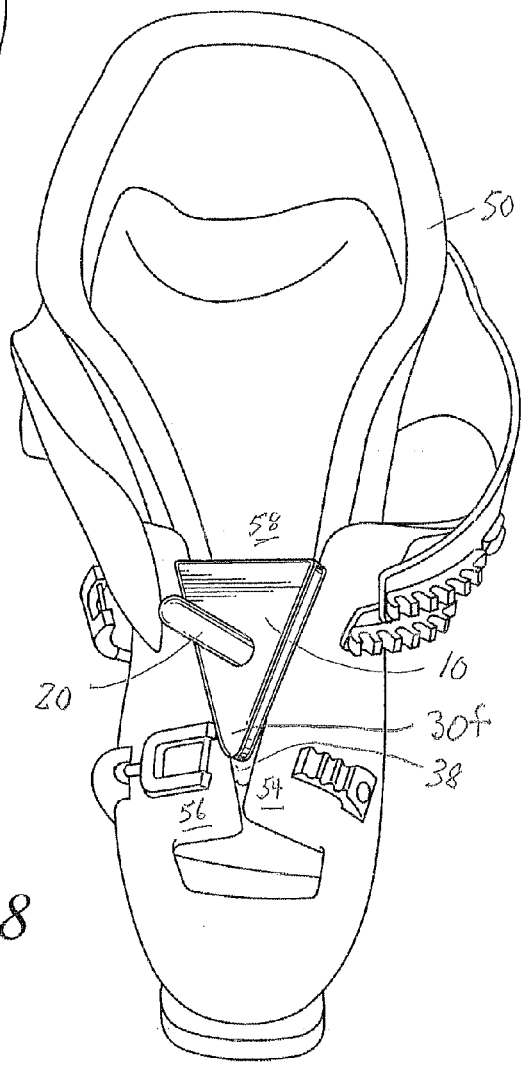
FIG. 8 is a perspective view of the ski boot spreader of FIG. 1 in a second position in a ski boot.

In one embodiment, the ski boot spreader 10 is used by gripping the handle 20, inserting the leading edge of the block nose 30*f* between the edges of the overlapping sections 54, 56 near the top of the first part of the boot shell with the flange 38 under the edges of the overlapping sections 54, 56 as shown in FIG. 7, and pushing (jamming) downward to spread the overlapping sections as shown in FIG. 7, thereby expediting insertion of the skier's foot (not shown) into the boot 50. Pushing further widens the opening as seen in FIG. 8. According to one embodiment, when the ski boot spreader 10 is pushed down, the edges of the overlapping sections 54, 56 of the first part of the boot shell separate from one another and ride in the undercuts 32, 34 that extend from the flange 38 and up two of the sides of the block 30, and the tongue 58 of the boot liner rides in the third undercut 36 where provided. According to one aspect, the spreader 10 may be left in place (i.e., the skier may let go of the handle 20), and the skier may use both hands to pull the boot 50 over the skier's foot or to hold the boot 50 while inserting his or her foot. According to a further aspect, after the skier has inserted his or her foot into the boot, the skier may grip the handle 20 of the spreader 10 and pull upward to release the spreader 10 from the overlapping sections 54, 56 of the boot 50 and remove the spreader 10.

According to another aspect, the ski boot spreader 10 may be used in helping the skier remove the boot 50 from his or her foot. With the boot on, the ski boot spreader 10 is used by gripping the handle 20, inserting the leading edge of the block nose 30*f* between the edges of the overlapping sections 54, 56 near the top of the first part of the boot shell with the flange 38 under the edges of the overlapping sections 54, 56 as shown in FIG. 7, and pushing (jamming) downward to spread the overlapping sections, thereby expediting removal of the skier's foot (not shown) from the boot 50. According to one aspect, the spreader 10 may be left in place (i.e., the skier may let go of the handle 20), and the skier may use both hands to pull the boot 50 off of the skier's foot.

According to another aspect, where the handle 20 of the spreader is removable from the block 30, prior to gripping the handle 20 in using the spreader for expediting insertion of the skier's foot into the boot or for expediting removal of the skier's foot from the boot, the handle 20 is coupled to the block 30. In one aspect, coupling is obtained by rotating the handle 20 relative to the block 30 so that the threads of the handle 20 engage a threaded hole in the top of the block 30.

According to a further aspect, where the handle 20 of the spreader 10 is removable from the block 30, the spreader 10 may be compactly stored by keeping the handle 20 removed from the block 30.

According to yet another aspect, the spreader 10, by consisting of either a single integral element, or two easily attachable elements with no moving parts, is inexpensive to manufacture and simple to use.

According to another aspect, the block 30 is solid except for the undercuts and handle-connecting hole (where applicable). However, if desired, the block 30 could be molded or drilled to have other holes to reduce the weight and/or material costs of the block, thereby rendering the block "substantially solid".

There have been described and illustrated herein several embodiments of a ski boot spreader and a method of its use. While particular embodiments have been described, it is not intended that this application be limited thereto, as it is intended that the application be as broad in scope as the art will allow and that the specification be read likewise. Thus, while particular sizes and angles have been disclosed for the block, it will be appreciated that other sizes and angles may be used as well. In addition, while particular types of materials have been disclosed, it will be understood that other materials can be used. It will therefore be appreciated by those skilled in the art that yet other modifications could be made without deviating from the spirit of the claims.

What is claimed is:

1. A ski boot spreader consisting essentially of:

a substantially triangular block, said block being substantially solid and having a first side surface, a second side surface angled relative to said first side surface and forming a leading nose area with said first side surface, a rear side surface extending from said first side surface to said second side surface, a top surface and a bottom surface, a flange extending beyond said first side surface and beyond said second side surface and around said nose area and located toward said bottom surface, wherein said first side surface defines a first undercut extending from a location at or behind said nose area to said rear side surface, and said second side surface defines a second undercut extending from a location at or behind said nose area to said rear side surface; and a handle extending from said top surface of said substantially triangular block.

2. A ski boot spreader according to claim 1, wherein:

said bottom surface defines a third undercut extending from a location at or behind said nose area to said rear side surface.

3. A ski boot spreader according to claim 1, wherein:

either said handle is integral with said substantially triangular block, or said handle has a threaded end, and said top surface of said substantially triangular block defines a threaded hole that receives said threaded end of said handle.

4. A ski boot spreader according to claim 1, wherein:

said first undercut deepens as it extends up said first side surface away from said bottom surface and forms a first shoulder, and said second undercut deepens as it extends up said second side surface away from said bottom surface and forms a second shoulder.

5. A ski boot spreader according to claim 4, wherein:

said bottom surface defines a third undercut extending from a location at or behind said nose area to said rear side surface, and said third undercut deepens and widens as it extends away from said nose toward said rear side surface.

6. A ski boot spreader according to claim 5, wherein:

said third undercut is symmetrical about a central longitudinal axis, and said third undercut is approximately seventy percent the height of the block at a central location of said rear side surface.

7. A ski boot spreader according to claim 1, wherein:

said first undercut is approximately forty to approximately seventy percent the height of said first side surface, and said second undercut is approximately forty to approximately seventy percent the height of said second side surface.

8. A ski boot spreader according to claim 7, wherein:

said substantially triangular block is between approximately one and approximately two inches high, and said rear surface forms an approximately seventy degree angle with each of said first side surface and said second side surface.

9. A ski boot spreader according to claim 1, wherein:

said nose is rounded.

10. A ski boot spreader, comprising:

a substantially triangular block, said block being substantially solid and having a first side surface, a second side surface angled relative to said first side surface and forming a leading nose area with said first side surface, a rear side surface extending from said first side surface to said second side surface, a top surface and a bottom surface, a flange extending beyond said first side surface and beyond said second side surface and around said nose area and located toward said bottom surface, wherein said first side surface defines a first undercut extending from a location at or behind said nose area to said rear side surface, and said second side surface defines a second undercut extending from a location at or behind said nose area to said rear side surface; and a handle extending from said top surface of said substantially triangular block.

11. A ski boot spreader according to claim 10, wherein:

said bottom surface defines a third undercut extending from a location at or behind said nose area to said rear side surface.

12. A ski boot spreader according to claim 11, wherein:

said nose is rounded, said first undercut deepens as it extends up said first side surface away from said bottom surface and forms a first shoulder, said second undercut deepens as it extends up said second side surface away from said bottom surface and forms a second shoulder, and said third undercut deepens and widens as it extends away from said nose toward said rear side surface.

13. A method of using a ski boot spreader on a ski boot having shell with first and second overlapping sections, comprising:

obtaining a ski boot spreader comprising a handle and a substantially triangular block, said block being substantially solid and having a first side surface, a second side surface angled relative to said first side surface and forming a leading nose area with said first side surface, a rear side surface extending from said first side surface to said second side surface, a top surface with said handle extending from said top surface, and a bottom surface, a flange extending beyond said first side surface and beyond said second side surface and around said nose area and located toward said bottom surface, said first side surface defining a first undercut extending from a location at or behind said nose area to said rear side surface, and said second side surface defining a second undercut extending from a location at or behind said nose area to said rear side surface;

with the handle engaging the substantially triangular block, gripping the handle and inserting the leading nose area between the first and second overlapping sections of the shell of the boot with the flange disposed under the first and second overlapping sections of the shell of the boot; and pushing the spreader downward with an edge of the first overlapping section of the shell of the boot in the first undercut and with an edge of the second overlapping section of the shell of the boot in the second undercut, thereby further spreading the overlapping sections of the shell of the boot.

14. A method according to claim 13, further comprising:

after pushing the spreader downward, inserting a foot into the ski boot, and after inserting, pulling up on the spreader and removing it from the ski boot.

15. A method according to claim 13, further comprising:

after pushing the spreader downward, removing a foot from the ski boot.

16. A method according to claim 15, further comprising:

after removing, pulling up on the spreader and removing it from the ski boot.

17. A method according to claim 16, further comprising:

disengaging the handle from the substantially triangular block.

18. A method according to claim 13, wherein:

said bottom surface defines a third undercut extending from a location at or behind said nose area to said rear side surface, and the ski boot has a liner with a tongue, and during said pushing, the third undercut rides over the tongue.

* * * * *